United States Patent [19]

Schwappach

[11] 4,077,729

[45] Mar. 7, 1978

[54] HOLDING CONSTRUCTION FOR DETACHABLE CONNECTION OF THE TOOTH TIP OF A DREDGE TOOTH

[75] Inventor: Dieter Schwappach, Dortmund, Germany

[73] Assignee: O & K Orenstein & Koppel Aktiengesellschaft, Dortmund, Germany

[21] Appl. No.: 734,276

[22] Filed: Oct. 20, 1976

[30] Foreign Application Priority Data

Oct. 21, 1975 Germany ..... 2547019

[51] Int. Cl.[2] ..... F16B 19/00

[52] U.S. Cl. ..... 403/379; 37/142 A

[58] Field of Search ..... 37/142 A; 85/8.3; 299/92; 403/379

[56] References Cited

U.S. PATENT DOCUMENTS

| | | | |
|---|---|---|---|
| 2,772,492 | 12/1956 | Murtaugh | 85/8.3 X |
| 2,798,403 | 7/1957 | Launder | 85/8.3 |
| 3,520,224 | 7/1970 | Hensley et al. | 403/379 X |
| 3,526,049 | 9/1970 | Nichols | 37/142 A |
| 3,675,350 | 7/1972 | Mulcahy | 299/92 X |
| 3,832,077 | 8/1974 | Von Mehren | 403/379 |

*Primary Examiner*—Andrew V. Kundrat
*Attorney, Agent, or Firm*—Walter Becker

[57] ABSTRACT

A holding construction for a detachable connection of a tooth tip having a sleeve-shaped section and a cutting edge to a holder connected to a digging implement, according to which the holder is provided with a holder opening having a somewhat trapezoidal cross section and being substantially parallel to the cutting edge while the longitudinal central plane of the holder opening substantially coincides with the longitudinal central plane of the holder. The tooth tip forming a part of a dredge tooth is connected to the holder by a connecting element arranged in the holder opening and extending parallel to the cutting edge of the digging implement and located in the central longitudinal plane of the holder. The connecting element detachably arranged in the sleeve-shaped section comprises a wider and a narrower metal part and a compressible elastomeric element, e.g. a rubber element, interposed between the two metal parts.

3 Claims, 4 Drawing Figures

HOLDING CONSTRUCTION FOR DETACHABLE CONNECTION OF THE TOOTH TIP OF A DREDGE TOOTH

The present invention concerns a holding construction for detachably connecting a tooth tip to a holder which is firmly connected to the cutting edge of a digging implement while that portion of the dredge tooth which is designed as a tooth tip is connected to the holder by a connecting element arranged parallel to the cutting edge in the longitudinal central line of said holder. This connecting element comprises two formed metal parts and a compressible rubber element interposed therebetween. This rubber element when in installed condition on one hand engages those surfaces of the tooth tip openings which face the cutting edge, and on the other hand engages those surfaces of a cut-out provided in the holder which face away from said cutting edge.

A heretofore known arrangement disclosed in German Auslegeschrift No. 1960411 concerns a plug connection for a dredge tooth while abutments of the lateral parts of the transverse bolt used for the connection extend over an elastic intermediate layer and leave between said lateral parts a gap the width of which in the longitudinal direction of the dredge tooth is less than the thickness of the elastic intermediate layer. The purpose of such an arrangement consists in that the elastic intermediate layer due to the dynamic stresses when carrying out digging operations will not be subjected to stresses beyond the extent permissible during continuous stresses. On the other hand, however, a strong spring force of the elastic intermediate layer is necessary in order to secure the connecting element in its position. In contrast to these stresses or loads during continuous operation, where continuous loadability of the elastic intermediate layer has to be taken into consideration, it would be possible during the driving in and out of the connecting elements when an exchange of the tooth tips becomes necessary, a stronger compression of the elastic intermediate layer could occur inasmuch as in this instance only a static load of the elastic intermediate layer is involved. This, however, cannot be realized with the heretofore known arrangement because the dynamic stresses of the elastic intermediate layer have to be taken into consideration so that as a result thereof the gap width will not permit any variable compression. The possible spring stroke of the elastic intermediate layer is therefore when driving out of the connecting elements, only partially made use of. If with the heretofore known arrangement, the gap would be increased and thus a greater compression of the elastic intermediate layer would occur, the rubber would due to the dynamic load during working operation soon reach the limit of its permissible loadability and would no longer be able to carry out its function as a spring element. Furthermore, with the heretofore known arrangement, the elastic intermediate layer is when driving out the connecting element compressed only unilaterally because the connecting element on each side is driven out only by one cam. As a result of this structural design and in view of the fact that the spring stroke cannot fully be used when driving out the connecting element, with the heretofore known arrangement only a portion of the spring force of the elastic intermediate layer can be taken advantage of.

The force of resistance of the connecting element against lateral forces thus is relatively low, and the tooth tip cannot be secured to the holder by means of the connecting element in the desired optimum manner.

It is, therefore, an object of the present invention so to improve the heretofore known dredge tooth that on one hand when statically driving out the connecting element, the rubber element will be stressed up to its elasticity limit and on the other hand during dynamic continuous load on the tooth tip when carrying out earth-working operations by means of a shovel provided with teeth of the above mentioned type, the elastic rubber element remains strong without signs of fatigue.

It is another object of the invention to provide a dredge tooth as set forth in the preceding paragraph, in which during the driving out of the connecting element, the rubber element will uniformly stressed over its entire length to obtain an optimum spring effect.

These and other objects and advantages of the invention will appear more clearly from the following specification in connection with the accompanying drawings, in which.

The holding construction according to the present invention is characterized primarily in that the holder is provided with a holder opening 19 which extends parallel to the cutting edge in the longitudinal central plane of the holder and has a somewhat T-shaped cross section. The surfaces of the cut-out along which the wider section of the cut-out merges with the narrower section thereof, have a rounded shape for reducing the notch effect. The wider portion of said T-shaped cross section of the connecting element is adapted to compress the rubber element of said connecting element until the said wider portion of said connecting element engages the said surface of the cut-out which merges the wider portion of the cut-out with the narrow portion thereof. The gap width between the wider portion and the last mentioned merging surface is so dimensioned that the said wider portion together with the rubber element and the narrower portion of said connecting element can be driven out by a cam surface on the wider portion and an inclined surface on said wider portion so that the rubber element will not be subjected to stresses which exceed the elastic limit of the rubber element, when the tooth tip is subjected to stresses occurring during the working of the dredge tooth.

The advantage of the arrangement according to the present invention consists primarily in that the rubber element, when driving out the connecting element for disengaging the tooth tip from the holder by means of the cams, the inclined surfaces, and the wedge-shaped surfaces of the wider and narrower portions of the connecting elements will be compressed to a greater extent and more specifically up to the elasticity limit of the rubber element than is the case when working with the shovel equipped with teeth according to the invention. The cams, inclined surfaces, and wedge-shaped surfaces of the connecting element, and the corresponding countersurfaces of the holder and of the tooth tip are so arranged that the rubber element, when driving out the connecting element over the entire length, will in contrast to the heretofore known arrangement be compressed substantially uniformly. This brings about that the spring force of the rubber element will for arresting the connecting element be taken advantage of to an optimum extent, and the tooth tips will even when subjected to the highest stresses find a firm hold on the tooth holder.

Figure 1:
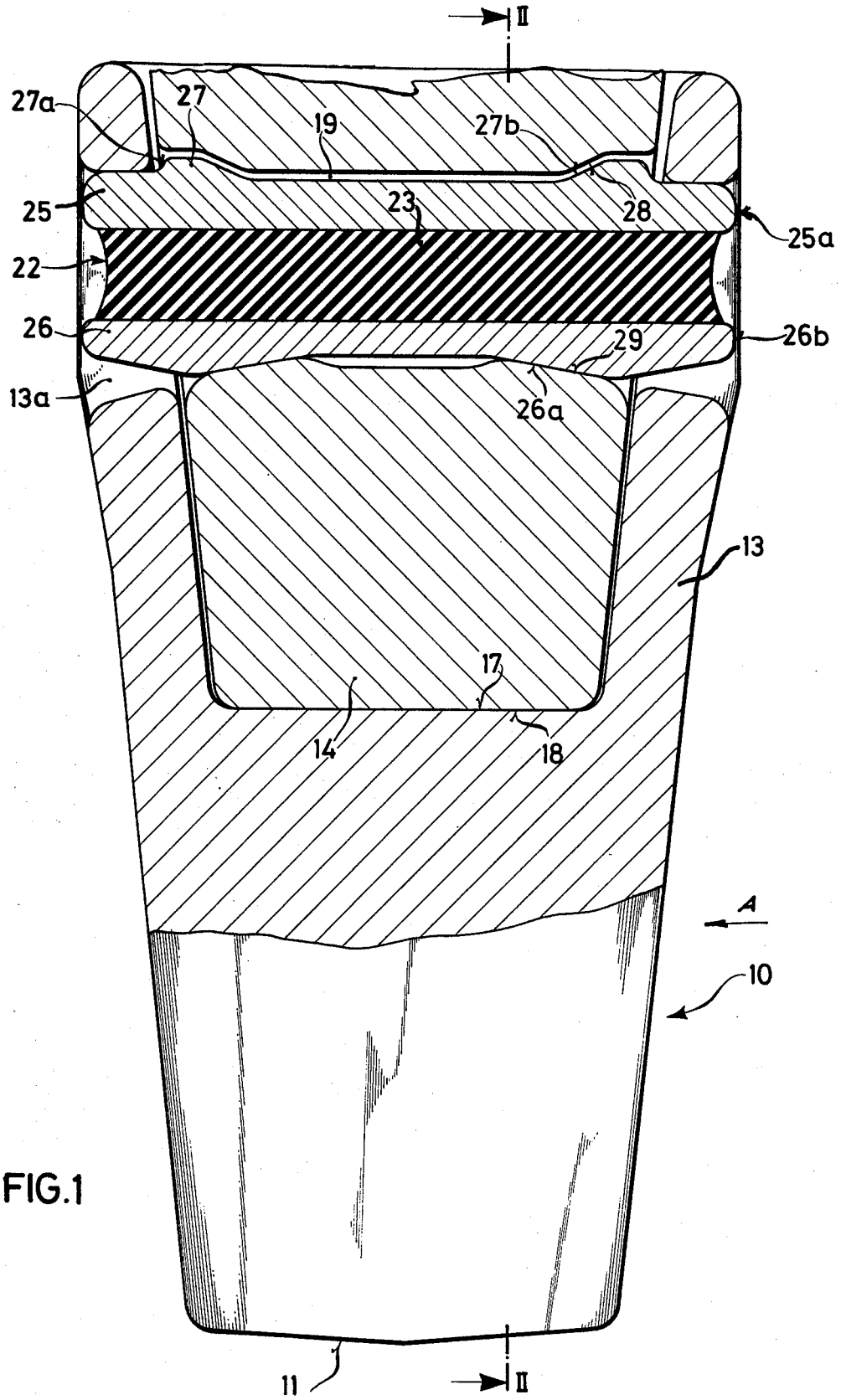
FIG. 1 represents a longitudinal section through the dredge tooth according to the invention.
Figure 2:
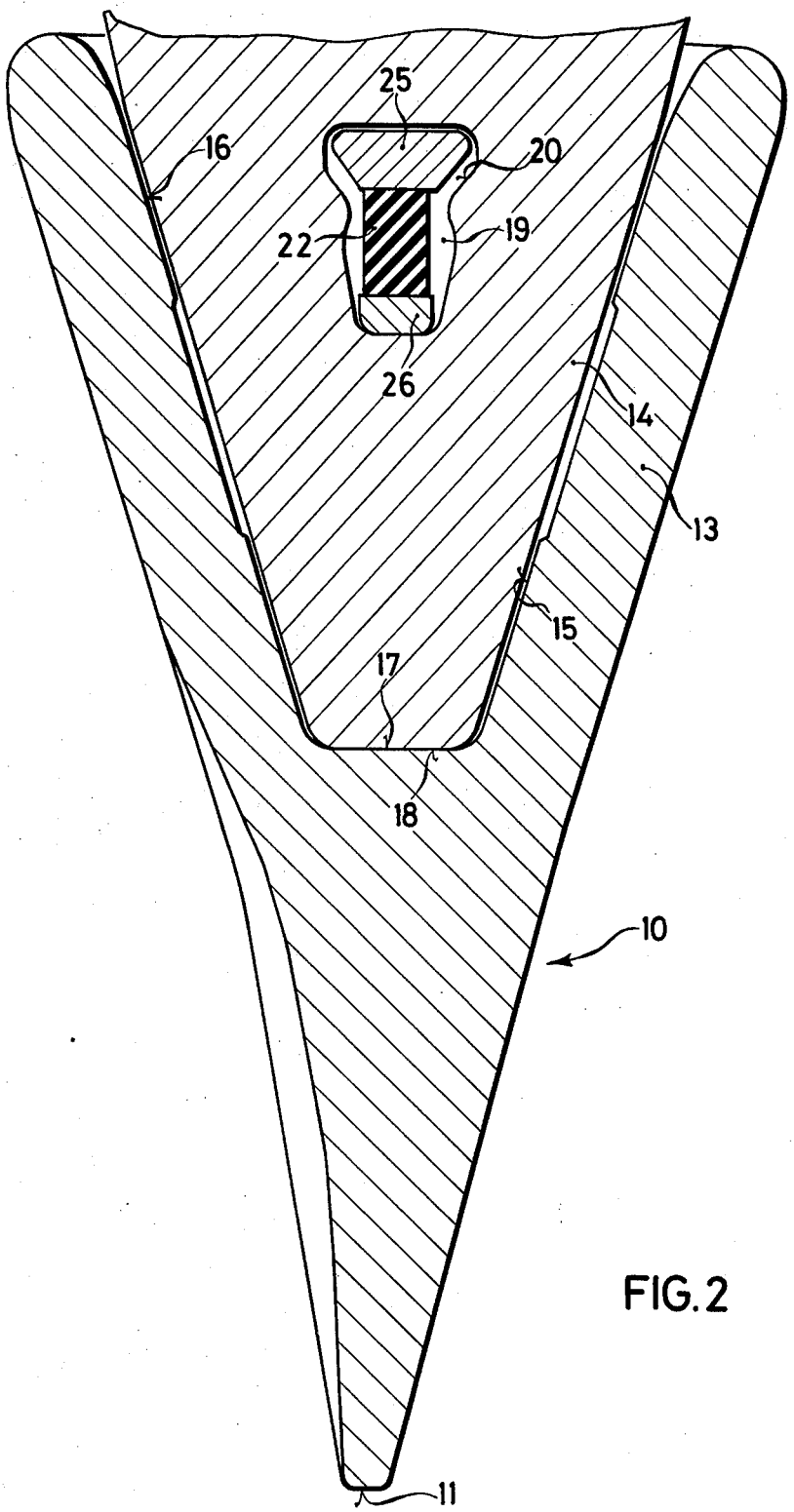
FIG. 2 is a longitudinal section through the dredge tooth according to the invention, said section being taken in the direction indicated by the arrow A in FIG. 1.
Figure 3:
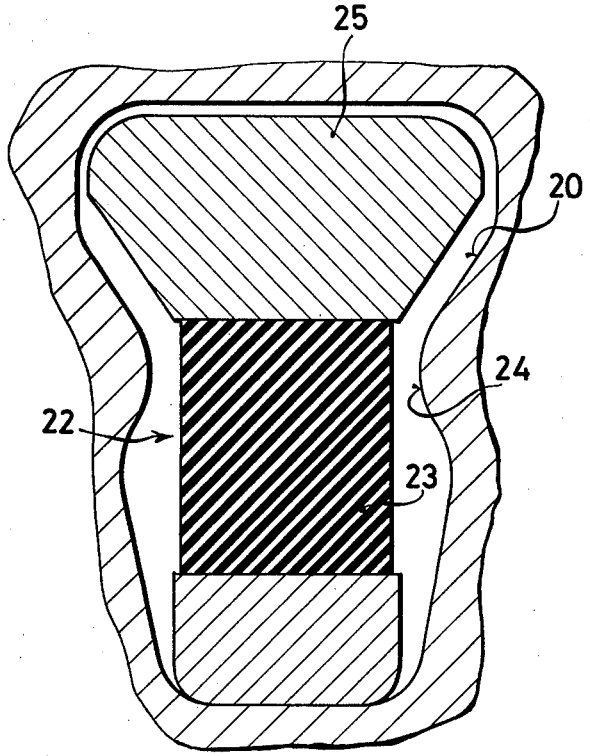
FIG. 3 represents on a larger scale than FIGS. 1 and 2 a section through the connecting element and the cut-out in the holder.
Figure 4:
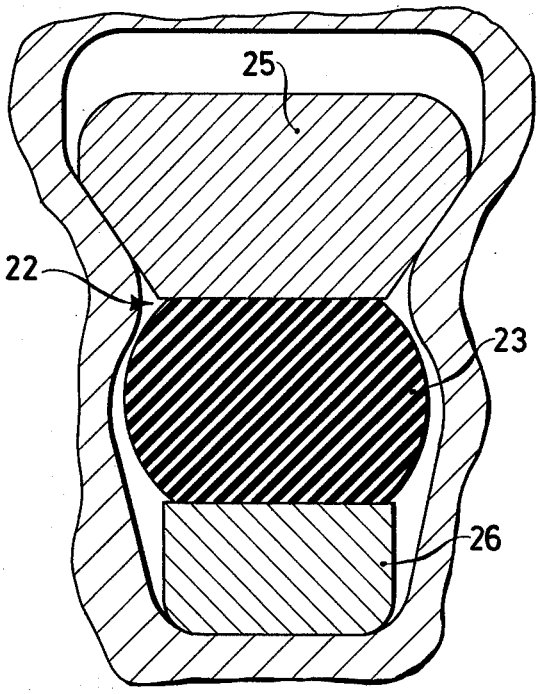
FIG. 4 is a partial section similar to that of FIG. 3, however showing the connecting element in compressed condition.

Referring now to the drawings in detail, the tooth tip 10 of the dredge tooth comprises a cutting edge 11 and a sleeve portion 13 by means of which the tooth tip is pushed over the holder 14. The inside of the sleeve portion 13 is so dimensioned that the holder 14 does not engage the inner walls 15 and 16 of said sleeve portion 13 but engages the end face 17 so that the forces acting in the longitudinal direction of the tooth are absorbed by the end face 18 of the holder 14. The lower third of the holder 14 is provided with a holder opening 19 extending parallel to the cutting edge 11 along the longitudinal central plane of said holder 14. In conformity with the opening of said straddling portion, the opening 13*a* of said straddling portion (FIG. 1) which opening widens by means of the abutment surface 20 so that the formed metal part 25 of the connecting element 25, 23, 26 will find sufficient place therein. At its narrower part, the holder opening 19 is widened to such an extent that the rubber element 23 even when the connecting element generally designated 22 is compressed to a maximum extent will during the driving in and driving out of the connecting element not engage the adjacent wall portions defining the holder opening 19 (FIG. 4). The merging area from the wider portion of the holder opening 19 to the narrower portion of the opening 19 is effected by the rounded transition surfaces 24. The connecting element 22 as mentioned above comprises the metal parts 25 and 26 and the rubber element 23 interposed therebetween. The metal part 25 is on that outside thereof which faces away from the foot of the holder 14 provided with cams 27 which on that cam surface 27*a*, which faces the sleeve portion 13 have a steeper angle of ascent than on the opposite side of cam 27. The holder 14 is provided with corresponding inclined surfaces 28 which cooperate with the inclined surfaces 27*b* of the cams 27. The metal part 26 is provided with inclined surfaces 26*a* which cooperate with corresponding inclined surfaces 29 of the holder 14.

The operation for driving out the connecting element 22 is as follows. When the service man by means of a heavy hammer knocks against the end faces of 25*a* and 26*b* of the metal parts 25 and 26 respectively, the rubber element 23 will be compressed via the inclined surfaces 26*a* and 29, first only gradually until the inclined surface 28 abuts the inclined surface 27*b* of the holder 14, and the cam surface 27*a* of the cam 27 abuts the sleeve portion 13. During the further phase of the driving out operation of the connecting element 22, a stronger compression of the rubber element 23 occurs than is the case when subjecting the connecting element during earthworking operations.

It is, of course, to be understood that the present invention is, by no means, limited to the specific showing in the drawings, but also comprises any modifications within the scope of the appended claims. Thus, the formed metal parts 25, 26 may also be provided with cams which have the same angle of ascent on both sides. If desired, also cams with a unilateral effect only may be employed. Furthermore, instead of the rubber element 23, also other elastic means, for instance, metallic springs may be employed.

What I claim is:

1. A holding construction for use in connection with a digging implement, which includes: a holder for connection to a digging implement, a tooth tip comprising a cutting edge and a sleeve-shaped section having said holder arranged therein, said holder having a holder opening with the approximate cross section of a trapezoid having its parallel sides extending substantially parallel to said cutting edge while the longitudinal substantially central plane of the holder opening substantially coincides with the longitudinal central plane of said holder, a connecting member extending through said holder opening and detachably engaging said sleeve-shaped section of said tooth tip while comprising a wider metallic section and a narrower metallic section and a compressible elastomeric element interposed between and connected to said two metallic sections, said connecting member extending substantially parallel to said cutting edge and normally having its narrower metallic section in engagement with that side of said holder opening which is adjacent thereto and when viewing said holder opening in cross section forms the shorter one of said two parallel sides of said trapezoid, the wall sections defining the sides of the holder opening and connecting the wider section of the holder opening with the narrower section thereof having tapering sections tapering toward said narrower sections thereof, and the wider metallic sections of said connecting member having lateral tapering sections tapering toward the elastomeric element for engagement with the tapering sections of said holder opening to limit the compression of the elastomeric element by the wider part of the connecting member within the elastic limit of the elastomeric element, the two metallic parts of said connecting member being provided with first cam means and said holder being provided with second cam means for cooperation with said first cam means to limit the compression of said elastomeric element within the elastic limit thereof when knocking said connecting member out of said holder for exchanging said holder.

2. A holding construction according to claim 1, in which said wider section of said connecting member is, adjacent those end portions thereof which detachably engage said sleeve-shaped sections, forming part of said first cam means, and in which said narrower section of said connecting member is provided with wedge-shaped sections.

3. A holding construction according to claim 2, in which said first cam means of said wider section of said connecting member have cam surfaces with a steeper slope on that side thereof which faces toward sleeve-shaped section and have cam surfaces of a less slope on the side opposite the respective adjacent steep slope.

* * * * *